United States Patent [19]

Childress

[11] 4,050,259

[45] Sept. 27, 1977

[54] SAFETY SHIELD AND TEMPORARY ROOF SUPPORT

[76] Inventor: Ray Childress, P.O. Box 86, Richlands, Va. 24641

[21] Appl. No.: 725,648

[22] Filed: Sept. 22, 1976

[51] Int. Cl.[2] ..... E21C 11/02

[52] U.S. Cl. ..... 61/63; 61/45 R; 173/23; 175/219

[58] Field of Search ..... 61/45 D, 45 R, 63; 173/23, 22, 52, 38; 182/112; 175/219, 213; 299/10, 11, 33

[56] References Cited

U.S. PATENT DOCUMENTS

| | | | |
|---|---|---|---|
| 2,711,634 | 6/1955 | Joy | 61/45 D |
| 3,143,862 | 8/1964 | Conlishaw | 61/45 D |
| 3,639,004 | 2/1972 | Lockwood et al. | 299/10 |
| 3,737,006 | 6/1973 | Long | 182/112 |
| 3,784,159 | 1/1974 | Skattman et al. | 173/23 |
| 3,865,197 | 2/1975 | McCormick | 173/23 |
| 3,937,517 | 2/1976 | Donovan et al. | 175/219 |

FOREIGN PATENT DOCUMENTS

| | | | |
|---|---|---|---|
| 826,897 | 1/1952 | Germany | 173/23 |

*Primary Examiner*—Dennis L. Taylor

[57] ABSTRACT

A safety shield attachment for protecting the operator of mine machines has a mounting plate for attachment to the machine, a platform pivoted to the mounting plate, and a canopy supported by hydraulic jacks from the mounting plate, the platform, and the ground.

6 Claims, 3 Drawing Figures

SAFETY SHIELD AND TEMPORARY ROOF SUPPORT

RELATED APPLICATION

Childress SAFETY SHIELD ATTACHMENT, Ser. No. 679,714, filed June 9, 1976 now U.S. Pat. No. 4,022,026.

FIELD OF INVENTION

Fire Escape, Ladders, Scaffolds, Safety Device, Platform Associated; and Mining or In Situ Disintegration of Hard Material, Hard Material Disintegrating Machines, With Roof Supporting Means.

PRIOR ART

Ryshamp U.S. Pat No. 3,259,211; Goodacre U.S. Pat. No. 3,268,033; Brondner U.S. Pat. No. 3,283,831; Weisker U.S. Pat. No. 3,638,758; Long U.S. Pat. No. 3,737,006 and U.S. Pat. No. 3,768,574; McCormick U.S. Pat. No. 3,865,197 and U.S. Pat No. 3,893,520; Donavan U.S. Pat. No. 3,937,517; Rogne, Jr. et al. U.S. Pat. No. 3,813,126; and Sodder, Jr. U.S. Pat. No. 3,879,088.

Coal Age, June, 1976, "Panel examines factors involved with the design of retrofit of cabs and canopies," pp. 137–141.

OBJECTS

In the mining of coal, in order to secure maximum protection against falling debris and roof cave-in, plates are usually bolted onto the roof, and oftentimes chocks are used to provide temporary roof support. Effort is made to limit the extent to which a miner works beneath unsecured roof areas, but even so, certain tasks must be carried out beneath un-plated or un-chocked roofs, these, for example, being the operation of a continuous miner (absent remote controls), running of surge cars, and operation of a roof drilling and bolting machine. Ordinarily, in a roof drilling and bolting machine the drill and bolt wrench are manually inserted into the drill chuck, and the operator of the machine generally works close alongside the boom of the machine so he can observe the operation, and this is a very dangerous location for him.

While the subject invention is useful for other machine operations, it is intended particularly for protection of operators of mine roof drilling and bolting machines, wherein not only the area occupied by the operator's station should be protected, but also an area to one side of the operator's station, where the drills, bolts and wrenches are placed in the chuck which drives them. To this end it is intended now to provide a platform for supporting the machine operator at a control station, a vertically adjustable canopy over the platform, a lateral extension of the canopy which overlies an area to one side of the operator's station (where the boom of a roof drilling and bolting machine works), and an extensible prop for supporting the outer extremity of the canopy extension from the ground. Thus constituted, the device functions somewhat like a chock which moves with the machine to which it is attached, and which not only protects the operator's station, but also an area to one side thereof.

A further object of the invention is to provide a safety shield attachment wherein a platform has an inboard end pivoted to a mounting plate, an outboard end which swings up or down about the pivot, a canopy having both its inboard and outboard ends connected to the platform by hydaulic jacks, and a lengthwise-extensible brace for the canopy by which the downward movement of its outboard end can be limited. By this arrangement, the platform can be made to function as a ground-engaging base for the jacks, and thereby support the canopy from the ground or, alternatively, by shortening the outboard jacks, the canopy can be made to function as a support from which the outboard end of the platform is suspended; and, as a third alternative, the platform may be left to "float, " i.e., to rest upon and accommodate itself to the ground while the canopy is maintained at a desired height and angle.

These and other objects will be apparent from the following specification and drawings, in which.

Figure 1:
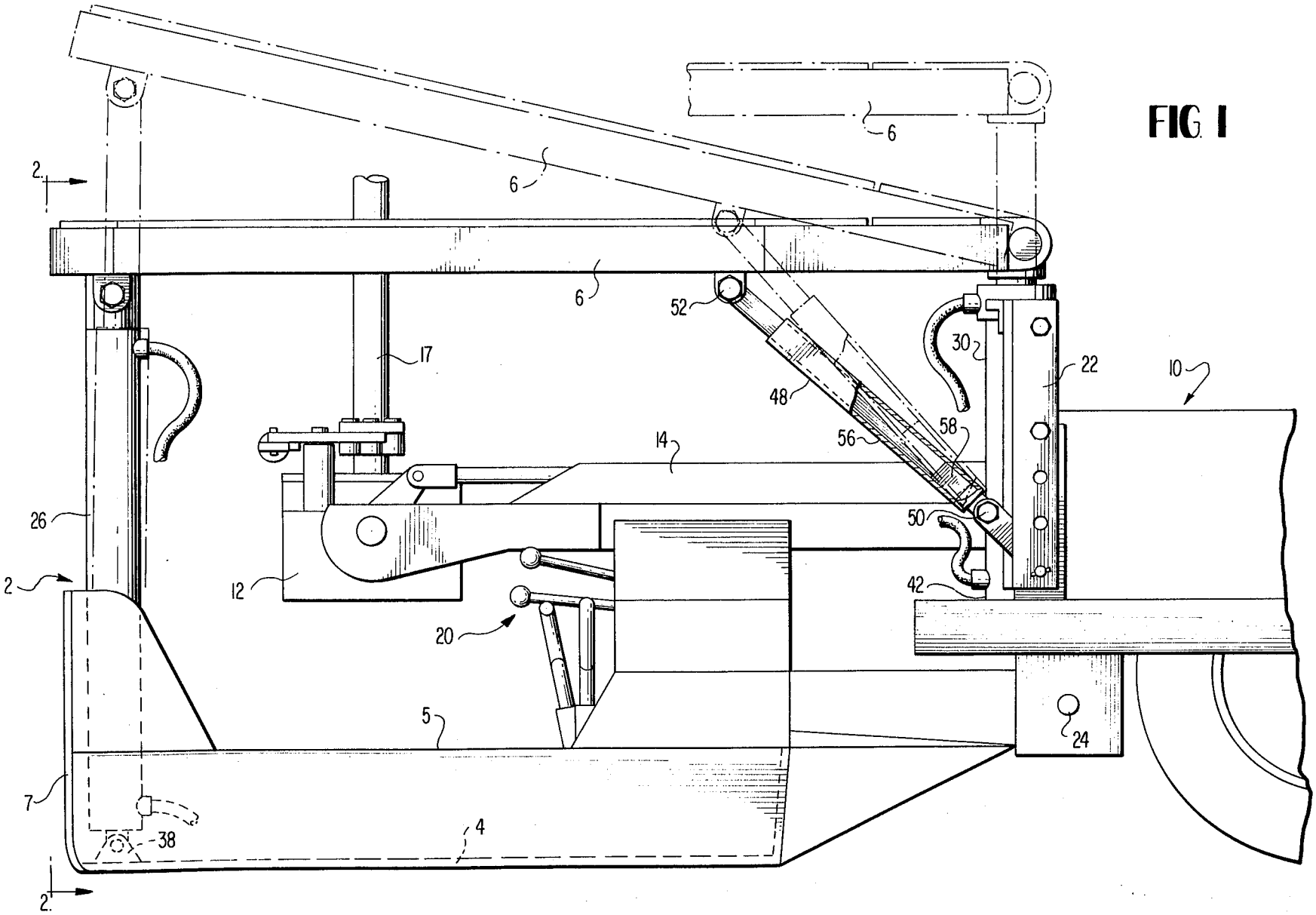
FIG. 1 is a side elevation.
Figure 2:
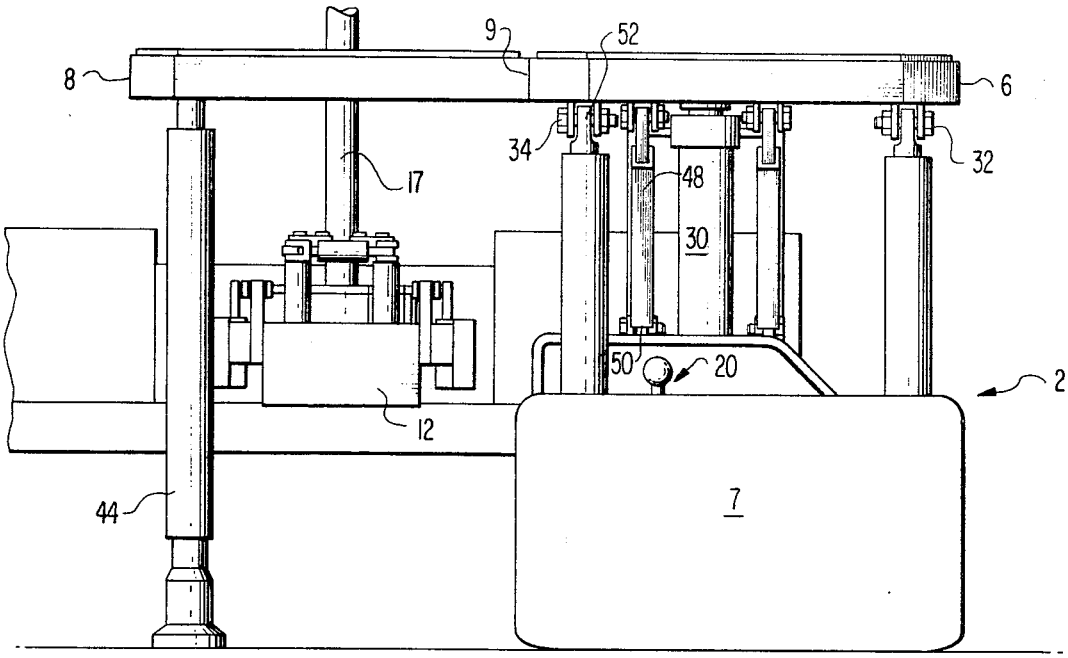
FIG. 2 is an end elevation.
Figure 3:
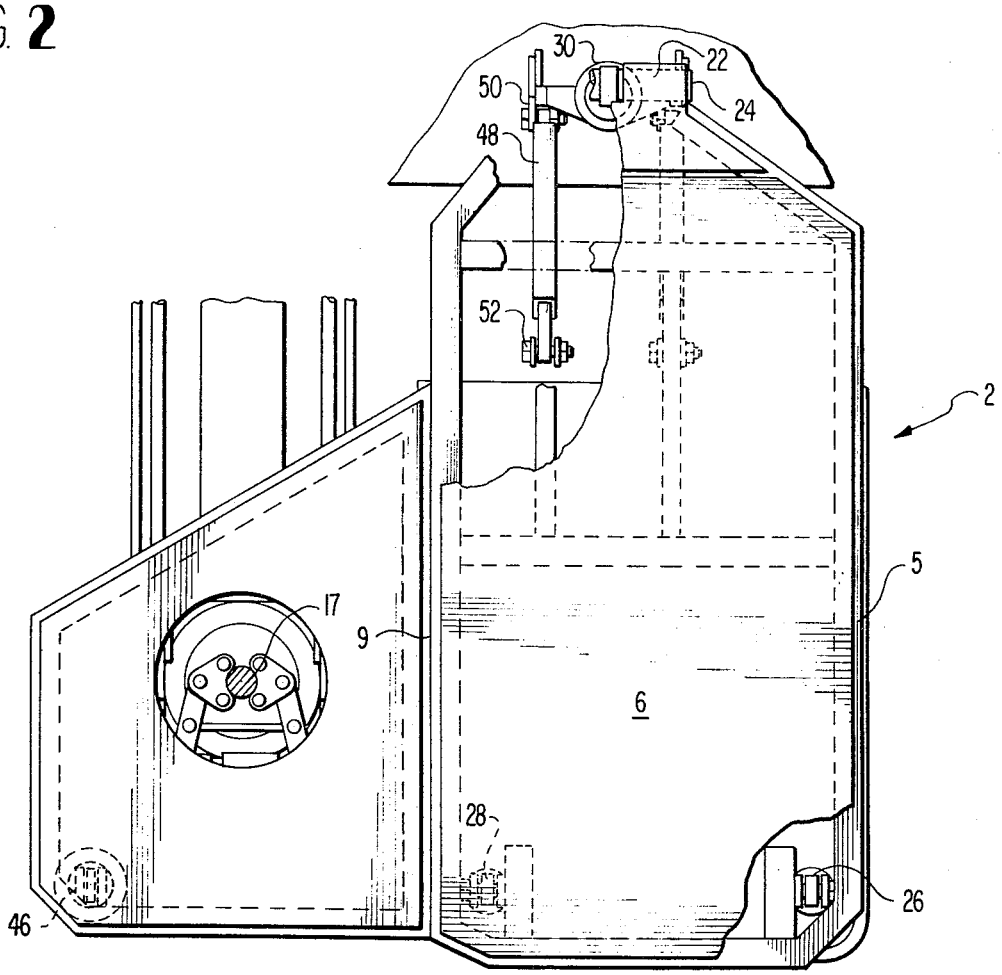
FIG. 3 is a top plan view, partly broken away, of the safety shield and temporary roof support.

Referring now to the drawings in which like reference numerals denote similar elements, the combined safety shield and temporary roof support 2 consists of the platform 4, and a canopy 6 having an extension 8 attached to one side thereof as indicated at 9. The extension may be rigidly connected or bolted to the canopy, as shown, or it may be pivoted thereto. Platform 4 has protective walls 5 and 7 at its sides and ends. The safety shield and temporary roof support is designed for attachment onto one end of a mine roof drilling and bolting machine 10 which has a drill box 12 carried by a boom 14. These machines are well known. The extension 8 has an opening 16 through which a drill steel 17 or roof bolt or bolt wrench engaged in a chuck in the drill box can be projected. On platform 4 is a control station 18 at which the operator of the machine manipulates controls 20 for the various mechanisms of the roof bolting machine and for the hydraulic jacks described hereinafter.

At the inboard end of the safety shield and temporary roof support is the mounting plate assembly 22 which is rigidly secured to the chassis of the mine roof drilling and bolting machine. The inboard end of platform 4 is pivoted as at 24 to the mounting plate. Canopy 6 is supported by two hydraulic jacks 26 and 28 extending upwardly from the outboard end of the platform 4, and a hydraulic jack 30 extending upwardly from the mounting plate assembly 22. The upper ends of the hydraulic jacks are pivoted to the canopy as indicated at 32, 34, 36; the lower ends of jacks 26 and 28 are pivoted to the platform as indicated at 38 for jack 26, and the lower end of jack 30 is secured as at 42 to the mounting plate. The free end of canopy extension 8 is supported from the ground by an extensible prop, i.e., a hydraulic jack 44 which is pivoted as at 46 to the free end of canopy extension 8. A telescoping diagonal brace 48 has one end pivoted as at 50 to the mounting plate assembly and its other end pivoted as at 52 to canopy 6. The extent to which the rod 54 of diagonal brace 48 can be telescoped into the sleeve 56 thereof can be predetermined by various well known mechanical means, the simplest being to insert a plug indicated at 58 into the lower end of sleeve 56. This will predetermine the minimum height of canopy 6 adjacent the pivot 52.

The hydraulic circuits for the jacks are not detailed, it being understood that their controls are mounted at the control station, and that they can be hydraulically shortened or lengthened as desired by the operator. Let it be assumed, first, that the roof drilling and bolting machine is to be moved from one location to another.

The extensible prop jack 44 is shortened, as are the outboard jacks 26 and 28 and the inboard jack 30. Canopy 6 with its extension are brought down to the minimum height determined by the length of plug 58 in the diagonal brace 48, and by the length of jack 30. The fluid is withdrawn from the outboard jacks 26 and 28 so as to shorten them and the outboard end of platform 4 is lifted up so that it becomes suspended from the outboard end of canopy 6.

Let it be assumed, next, that it is desired that platform 4 be allowed to rest upon the ground and "float" along it as the mine roof drilling and bolting machine is moved. This is done by releasing the hydraulic fluid from both ends of jacks 26 and 28, whereupon the outboard end of platform 4 comes to rest upon the ground 58. If, then, it is desired to support the mine roof, pressure fluid is introduced into all the hydraulic jacks and the canopy 6 with its extension 8 is rammed up against the mine roof. Thereupon the desired operations of the mine roof can ensue. When it is desired to move the machine, the jacks are operated so as to lower canopy 6 and its extension 8 to its minimal height, which is generally determined by the thickness of the seam in which the machine is operating. If the extension 8 is pivoted to the canopy, the boom of the roof drilling and bolting machine is raised beneath it for support when the machine is to be moved about.

The outboard end of canopy 6 can be tipped upwardly or downwardly by lengthening or shortening hydraulic jacks 26 and 28 as likewise can be the inboard end by lengthening or shortening hydraulic jack 30. The pivot 46 has a universal swiveling action which permits the extensible prop jack 44 to find a vertical position so that when it is extended to engage the ground, it will provide direct and firm support therefrom for the free end of canopy extension 8.

Although the safety shield and temporary roof support has been described as it would typically be used with a mine roof drilling and bolting machine, it will be understood that it is adaptable to other types of machines where the operator must be protected. The canopy extension 8 can be attached to either side of the canopy 6 or, if desired, extensions may be attached to both sides; or in certain cases where protection is not needed or is not feasible in the area disposed laterally of the operator's station, the extension may be shortened or eliminated entirely.

I claim:

1. A safety shield and temporary mine roof support comprising a mounting assembly for attachment to a machine to be controlled, a platform having inboard and outboard ends said platform having thereon between the ends thereof a control station for said machine and providing a support adjacent said control station for a machine operator, means pivotally mounting the inboard end of said platform to said mounting assembly, a canopy having a part thereof overlying the control station and the operator's support on the platform and having inboard and outboard ends, extensible-retractable hydraulic jacks means having opposite ends respectively pivoted to the outboard ends of the platform and canopy, extensible-retractable hydraulic jack means having one end pivoted to the inboard end of the canopy and means supporting the other end from said mounting assembly, and means for supplying pressure and return fluid to and from said hydraulic jack means.

2. A safety shield and temporary mine roof support comprising a mounting assembly for attachment to a machine to be controlled, a platform having inboard and outboard ends and an operator's station for said machine, means pivotally mounting the inboard end of said platform to said mounting assembly, a canopy having a part thereof overlying the platform and having inboard and outboard ends, extensible-retractable hydraulic jack means having opposite ends respectively pivoted to the outboard ends of the platform and canopy, extensible-retractable hydraulic jack means having one end pivoted to the inboard end of the canopy and the other end connected to said mounting assembly, means for supplying pressure and return fluid to and from said hydraulic jack means, said canopy having an extension with a free end portion extending outwardly therefrom and overlying an area laterally of the operator's station, and extensible hydraulic jack means depending from said free end portion of the extension, and pivot means for connecting one end of said extensible hydraulic jack means to the free end of the canopy extension.

3. A safety shield and temporary roof support as claimed in claim 1, and elongate diagonal brace means having one end pivoted to the mounting assembly and the other end pivoted to the canopy at a location on the canopy which is spaced from the inboard end thereof.

4. A safety shield and temporary mine roof support comprising a mounting assembly for attachment to a machine to be controlled, a platform having inboard and outboard ends and an operator's station for said machine, means pivotally mounting the inboard end of said platform to said mounting assembly, a canopy having a part thereof overlying the platform and having inboard and outboard ends, extensible-retractable hydraulic jack means having opposite ends respectively pivoted to the outboard ends of the platform and canopy, extensible-retractable hydraulic jack means having one end pivoted to the inboard end of the canopy and the other end connected to said mounting assembly, means for supplying pressure and return fluid to and from said hydraulic jack means, and elongate diagonal brace means having one end pivoted to the mounting assembly and the other end pivoted to the canopy at a location on the canopy which is spaced from the inboard end thereof, said diagonal brace means being extensible, and retractable in the direction of its length, and means for selectively limiting the retraction thereof.

5. A safety shield and temporary roof support as claimed in claim 2, said canopy extension being adapted to overlie the free end of the boom on a roof drilling and bolting machine, and said canopy extension having an opening therethrough for permitting drill steels, bolts and wrenches operated from a drill box on the free end of the boom to pass therethrough.

6. A safety shield and temporary roof support as claimed in claim 2, the pivot means for connecting one end of said extensible hydraulic jack means to the free end of the canopy extension comprising a swivel.

* * * * *